US006109044A

United States Patent [19]

Porter et al.

[11] Patent Number: 6,109,044

[45] **Date of Patent: *Aug. 29, 2000**

[54] CONDITIONED AIR FAN COIL UNIT

[75] Inventors: Ronald D. Porter; Kim A. Sabatino, both of Edmond, Okla.

[73] Assignee: International Environmental Corp., Oklahoma City, Okla.

[ * ] Notice: This patent issued on a continued prosecution application filed under 37 CFR 1.53(d), and is subject to the twenty year patent term provisions of 35 U.S.C. 154(a)(2).

[21] Appl. No.: 09/013,326

[22] Filed: Jan. 26, 1998

[51] Int. Cl.[7] ..... F25D 17/06

[52] U.S. Cl. ..... 62/96; 62/525; 165/104.21

[58] Field of Search ..... 62/95, 96, 97, 62/404, 407, 406, 524, 525, 186, 216, 413, 415; 165/104.21

[56] References Cited

U.S. PATENT DOCUMENTS

| | | | |
|---|---|---|---|
| 2,222,237 | 11/1940 | Philipp | 62/216 |
| 2,285,042 | 6/1942 | Macdonald | 62/427 |
| 2,296,741 | 9/1942 | Sandars, Jr. . | |
| 2,328,472 | 8/1943 | Lehane et al. | 62/524 |
| 2,540,957 | 2/1951 | Newton . | |
| 2,907,178 | 10/1959 | McNatt | 62/95 |
| 2,972,236 | 2/1961 | Nussbaum . | |
| 3,722,580 | 3/1973 | Braver . | |
| 3,933,004 | 1/1976 | Carter . | |
| 3,938,348 | 2/1976 | Rickert | 62/97 |
| 4,127,162 | 11/1978 | Braver . | |
| 4,434,843 | 3/1984 | Alford . | |
| 4,462,460 | 7/1984 | Braver . | |
| 4,607,498 | 8/1986 | Dinh | 62/185 |
| 5,159,972 | 11/1992 | Gunnerson et al. | 165/32 |
| 5,309,725 | 5/1994 | Cayce . | |
| 5,346,127 | 9/1994 | Creighton . | |
| 5,400,607 | 3/1995 | Cayce . | |
| 5,404,938 | 4/1995 | Dinh . | |
| 5,408,838 | 4/1995 | Yaeger et al. | 62/92 |
| 5,660,056 | 8/1997 | Arai et al. | 62/324.6 |
| 5,695,004 | 12/1997 | Beckwith | 165/104.21 |
| 5,709,097 | 1/1998 | Kim et al. . | |
| 5,743,098 | 4/1998 | Behr . | |

OTHER PUBLICATIONS

International Environmental Corp. Fan Coil Brochure (20 Pages) (Published 1990, U.S.).

Abstract of Japanese Patent No. 62–252843 (A), entitled Multichamber Type Air Conditioner, published/granted Nov. 4, 1987.

*Primary Examiner*—William Doerrler
*Attorney, Agent, or Firm*—Mary M. Lee

[57] ABSTRACT

A fan coil unit comprising an air conditioning coil using a main cooling coil surrounding by a heat pipe. The cooling coil is face-split to form a first portion for conditioning inside air, as needed, and second portion for continuously conditioning outside air. The air conditioning coil is positioned between an pre-cooler or evaporator coil and a re-heater or condenser coil. The pre-cooler and re-heater are comprised of a plurality of passive heat pipes, at least one circuit for each of the first and second portions of the face-split cooling coil. Each of the circuits is a continuous length of pipe folded into a C-shape having a crossover end and a hair pin end. In this way, vapor can rise in the upper portion of the pre-cooler side, through the upper crossover pipe, to the re-heater side. On the re-heater side, the vapor condenses, and the liquid flows through the hair pin end, down the lower portion of the pipe on the re-heater side, down the lower crossover pipe and returns to the lower portion of the pipe on the pre-cooler side. Thus, each circuit acts as a passive heat pipe. Chilled water is continuously circulated through the second portion to condition outside air and is selectively circulated through the first portion to condition room air in response to a thermostat.

14 Claims, 5 Drawing Sheets

CONDITIONED AIR FAN COIL UNIT

FIELD OF THE INVENTION

The present invention relates to devices for conditioning air and, more particularly, to fan coil units.

SUMMARY OF THE INVENTION

The present invention is directed to a fan coil unit for conditioning the air inside a structure. The unit comprises a housing and an air conditioning coil in the housing. The air conditioning coil comprises a main cooling coil, a pre-cooler coil upstream of the main cooling coil, and a re-heater coil downstream of the main cooling coil. The main cooling coil comprises a first portion and a second portion. Means is included for directing inside air from inside the structure through the first portion of the main cooling unit and for directing outside air through the second portion. Means is included for circulating refrigerant through the main cooling coil so that refrigerant is continuously circulated through the second portion and whereby refrigerant is selectively circulated through the first portion in response to the temperature of the air inside the structure. A blower assembly is provided to circulate air through the housing, which has a conditioned air outlet downstream of the heat exchanger.

BRIEF DESCRIPTION OF THE DRAWINGS

FIG. 9 is an exploded, plan view of the air conditioning coil.

DETAILED DESCRIPTION OF THE PREFERRED EMBODIMENT

Fan coil units provide good cooling of room air in structures. However, in humid climates, it may be difficult to remove enough of the moisture in the air to provide a comfortable atmosphere. Improved dehumidification is provided by the phase-change heat pipe technology described in U.S. Pat. No. 4,607,498 issued Aug. 26, 1986 entitled HIGH EFFICIENCY AIR-CONDITIONER/DEHUMIDIFIER, the entire contents of which are hereby incorporated by reference. In the present invention, even greater air quality is achieved by combining this technology with "face-split" main evaporator or cooling coil. In this way, fresh outside air is continuously conditioned and blended with the room air, while the room air may be selectively cooled as needed. The controlled introduction of conditioned outside air in the return air stream addresses "sick building" syndrome, provides more efficient cooling and improved dehumidification.

Figure 1:
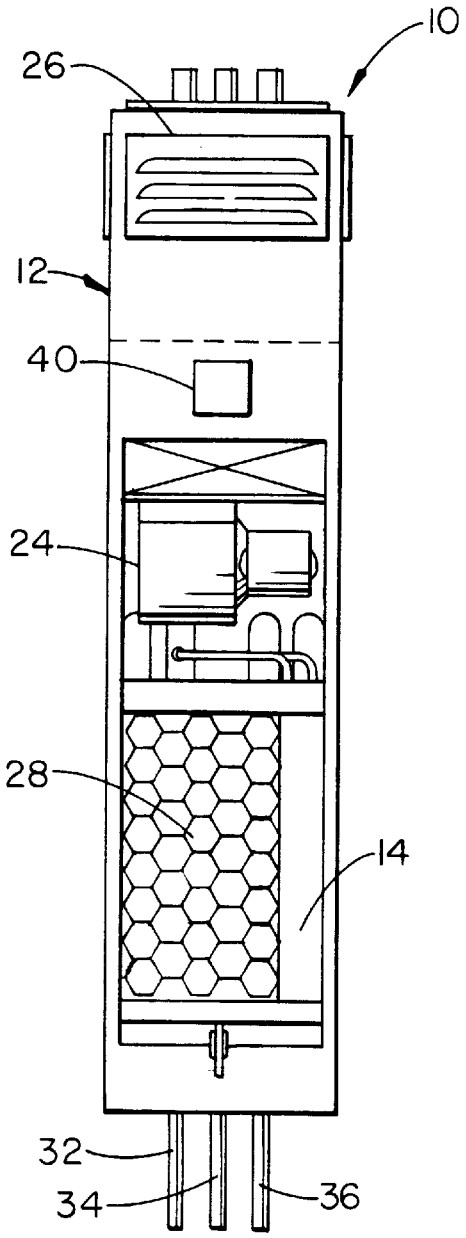
FIG. 1 is a front elevational view, partially cutaway, of a fan coil unit constructed in accordance with the present invention.
Figure 2:
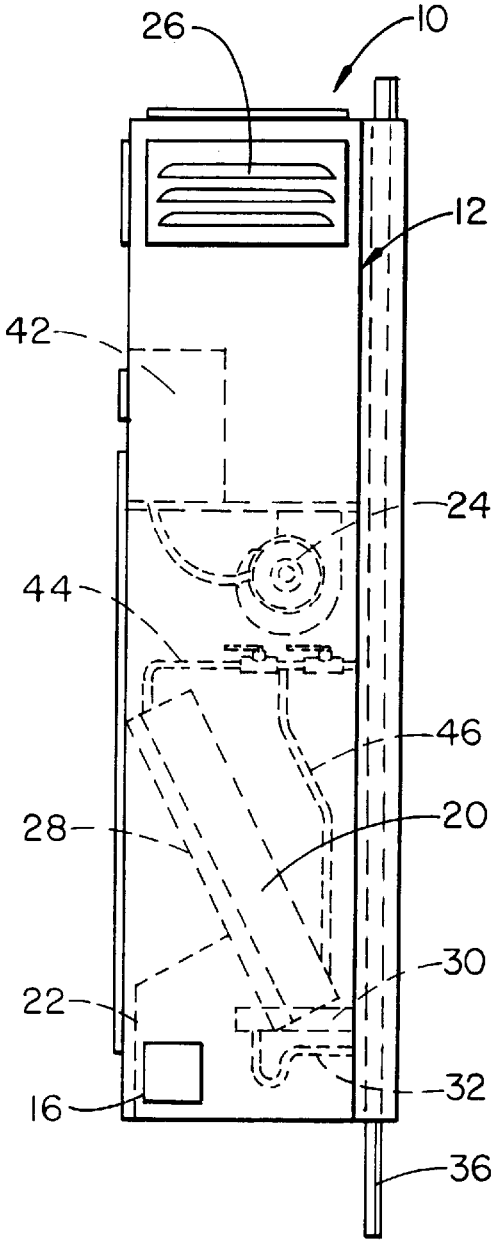
FIG. 2 is side elevational view, partially cut away, of the fan coil unit shown in FIG. 1.

With reference to the drawings in general and to FIGS. 1 and 2 in particular there is shown therein a fan coil unit constructed in accordance with the present invention and designated generally by the reference numeral 10. The unit 10 comprises a cabinet or housing 12 having an inside air inlet 14 and an outside air inlet 16. An air conditioning coil 20 is supported in the lower portion of the housing 12. The lower portion of the housing 12 is provided with baffles 22 whereby air flow from inside the structure (not shown) is directed through the upper portion of the air conditioning coil 20 and fresh air from the outside is directed through the lower of the coil 20.

Air exiting the air conditioning unit exits the housing through the conditioned air outlet 26. A blower 24 is positioned in the midportion of the housing 12 to circulate air through the housing, that is, to pull air through the air conditioning coil 20 and force it out through the outlet 26. A filter 28 may be provided at the front of the coil 20 to filter the air as it is cooled and dehumidified. A drain pain 30 with associated drain line 32 is supported beneath the air conditioning unit to collect and remove water condensed from the from the air being conditioned.

Chilled water, or some other suitable refrigerant, is continuously circulated through the unit 20 by means of the risers 34 and 36 from a source (not shown). A thermostat 40 and associated control assembly 42 are included for automatically controlling the flow of refrigerant to the upper portion of the coil 20, as described hereafter. The risers 34 and 36 connect to inlet and outlet lines 44 and 46 for the upper portion and the lower portions, respectively, of the coil 20.

Figure 3:
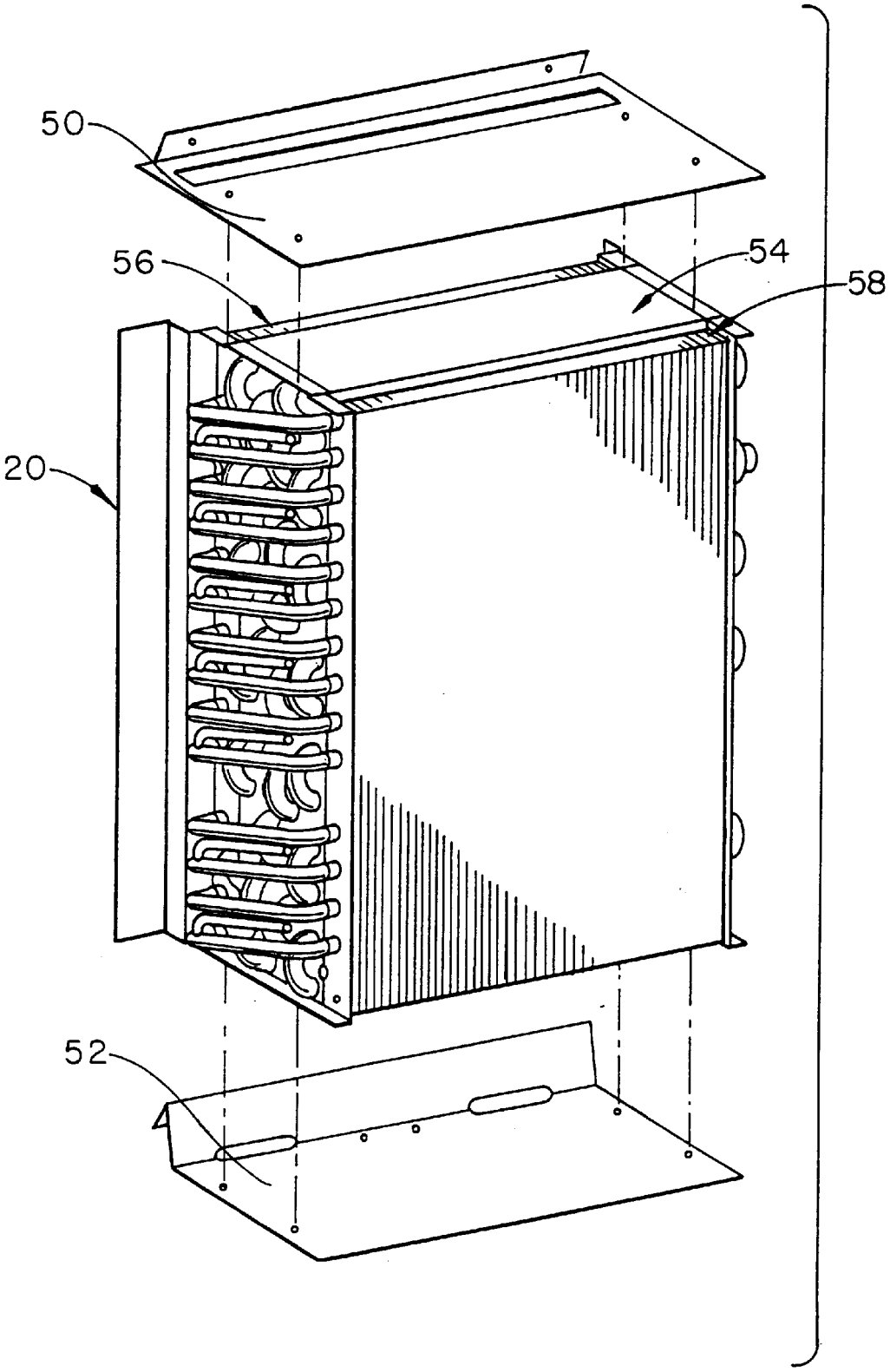
FIG. 3 is a rear perspective view of the air conditioning coil of the fan coil unit shown in FIG. 1.

As illustrated in FIG. 3, the coil 20 is supported by a frame of some sort such as the top and bottom plates 50 and 52. The coil 20 comprises generally three sections, a main cooling coil 54, an evaporator coil or pre-cooler 56 and a condenser coil or re-heater 58. Each of the main coil 54, the pre-cooler 56 and the re-heater 58 comprises finned tubes.

Figures 3, 4, 5:
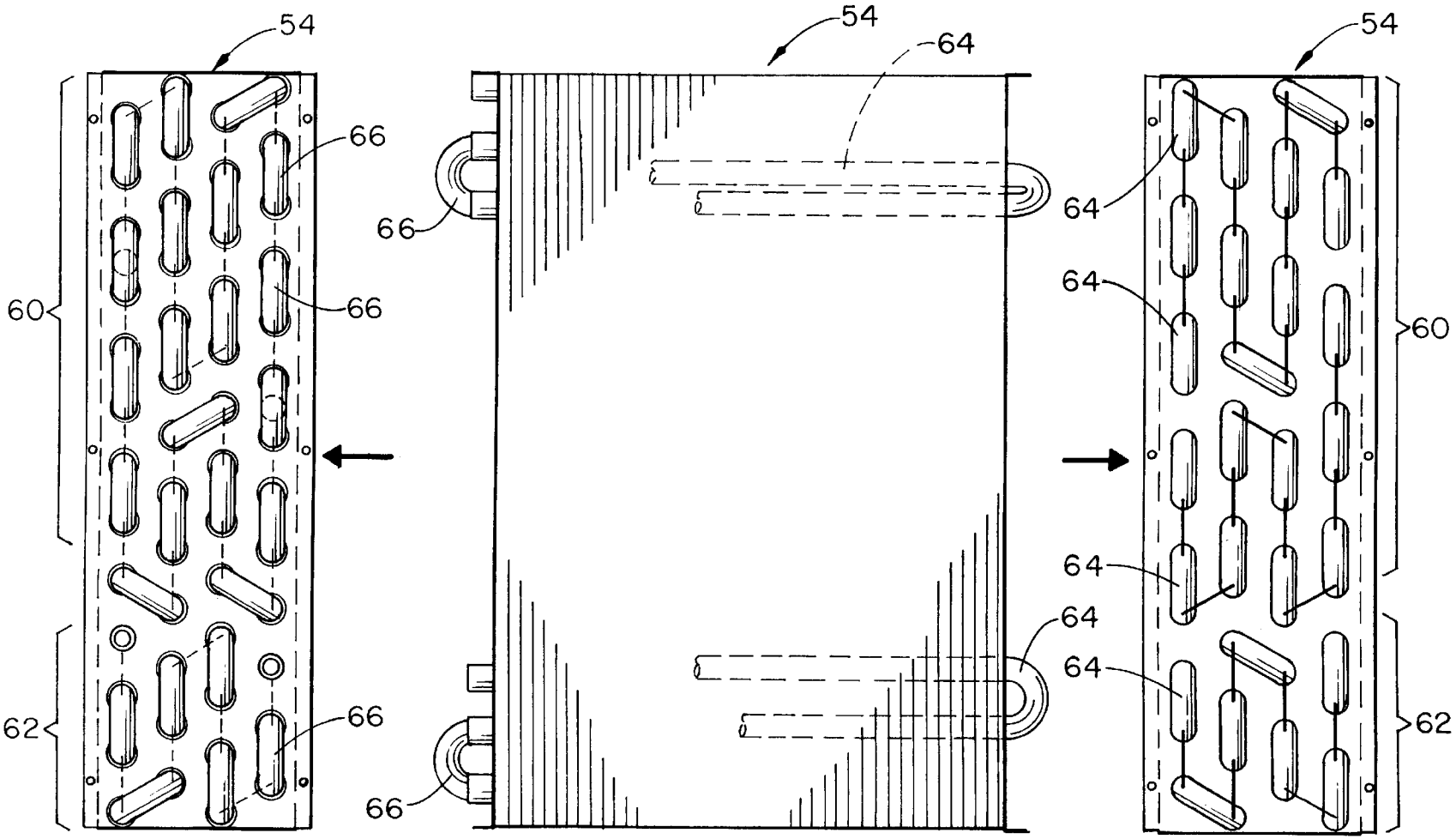
FIG. 4 is a side elevational view of the main cooling coil of the air conditioning coil used in the fan coil unit of FIG. 1.
FIG. 5 is an elevational view of the hairpin end of the main cooling coil.
Figure 6:
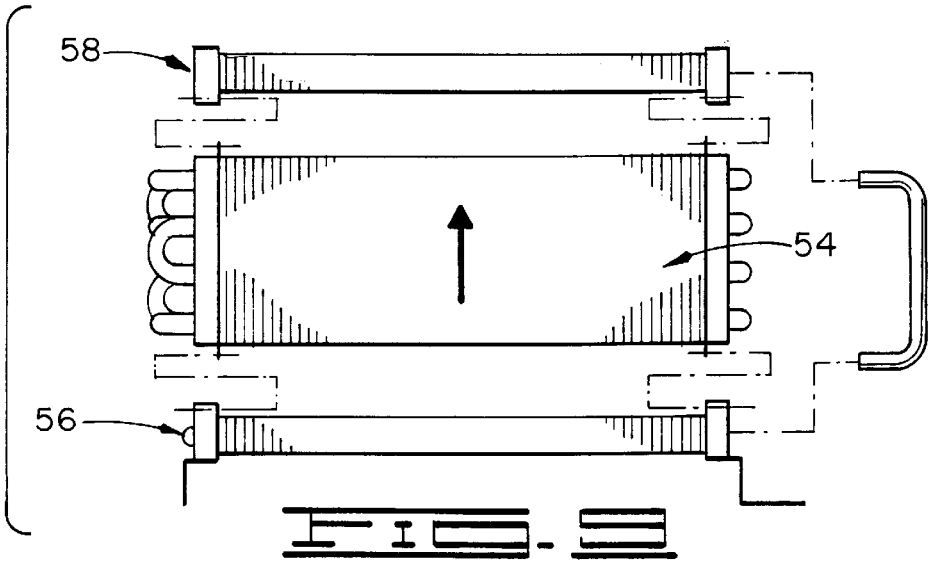
FIG. 6 is an elevational view of the return bend end of the main cooling coil.

The configuration of the main cooling coil 54 is illustrated in FIGS. 4, 5 and 6, to which attention now is directed. In the embodiment shown the main cooling coil 54 is a four row coil, but other numbers of rows may used. The main cooling coil 54 is face split, that is, the coil 54 is divided into a first or upper portion 60 and a second or lower portion 62. Room air is circulated through the first portion 60, as the temperature requires, and outside air is continuously circulated through the lower or second portion 62. The coils preferably are formed by using hair pin loops 64 of pipe connected at the other end of the unit 54 by return bends 66.

The unit illustrated herein is built only to cool air. It will be appreciated that a heater coil could be included in the main coil 20.

Figure 7:
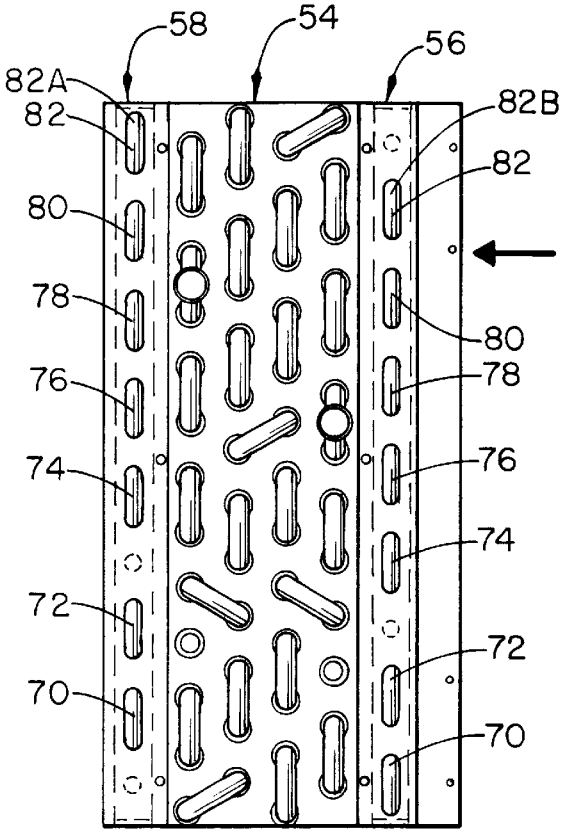
FIG. 7 is an elevational view of the air conditioning coil showing the hair pin end of the evaporator coils and the condenser coils.
Figure 8:
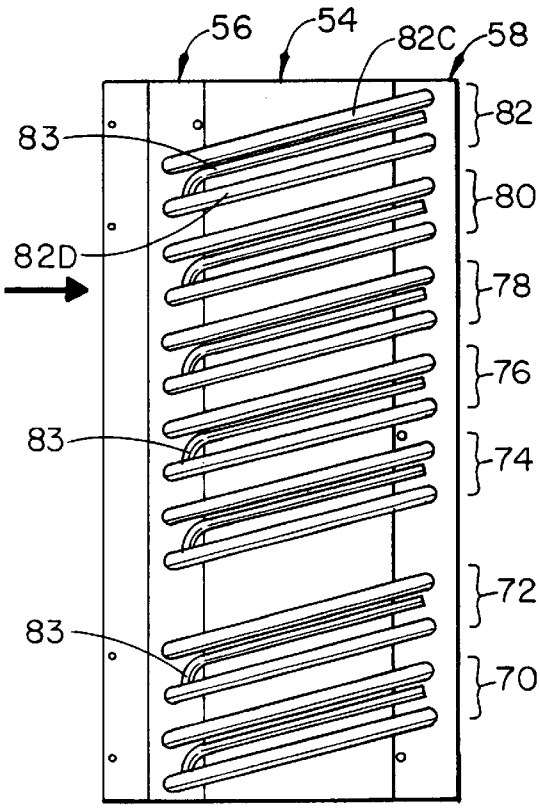
FIG. 8 is an elevational view of the crossover end of the evaporator coils and the condenser coils. The hairpin ends of the main coil have been omitted to simplify the illustration.

Turning now to FIGS. 7, 8 and 9, the configuration of the pre-cooler coil 56 and the re-heater coil 58 will be explained.

The pre-cooler 56 and the re-heater 58 are formed of a plurality of individual heat pipes 70, 72, 74, 76, 78, 80 and 82, seen in FIGS. 7 and 8. FIG. 7 shows the hair pin ends of the heat pipes, and FIG. 8 shows the crossover ends of the heat pipes.

Figure 10:
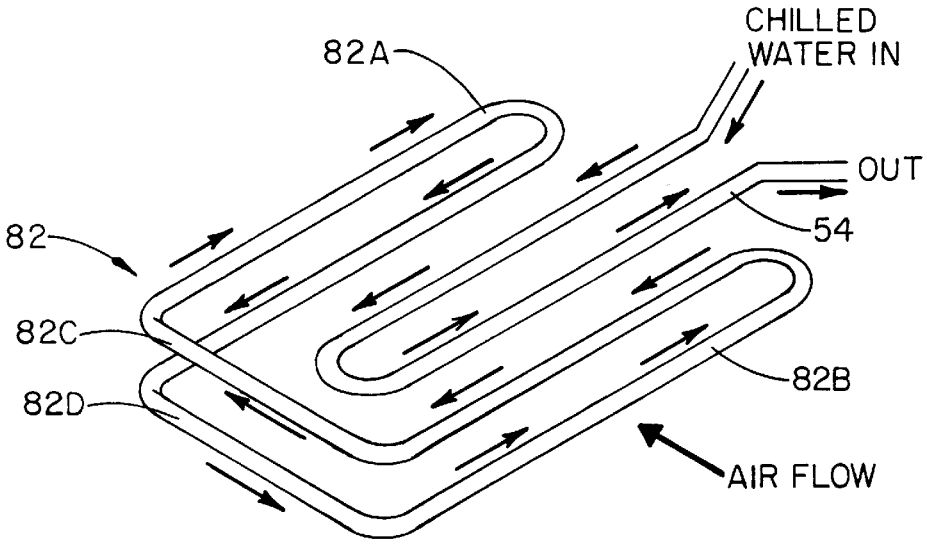
FIG. 10 is a schematic diagram one of the heat pipe coils and a loop of the cooling coil in the air conditioning coil.

Each of the heat pipes 70, 72, 74, 76, 78, 80 and 82 is similarly formed, so only one is described in detail. As shown best in FIG. 10, the heat pipe 82 is a closed loop formed by two hair pin tubes 82A and 82B connected into a single circuit by two crossover tubes 82C and 82D. Thus, one C-shaped half of the pipe is parallel to the other C-shaped half. The heat pipe 82 is tilted so that the hair pin section 82A is higher than the hair pin section 82B. The higher hair pin section 82A is on the outlet or re-heater side of the air conditioning coil 20, and the lower hair pin section 82B of the pipe 82 is on the inlet or pre-cooler side. Each of the heat pipes 70, 72, 74, 76, 78, 80 and 82 is evacuated of air and injected with a refrigerant, such as Freon Brand refrigerant, by means of the process tube 83 (See FIGS. 6, 8 and 11). Then, each of the heat pipes functions independently as a passive heat pipe.

Figure 11:
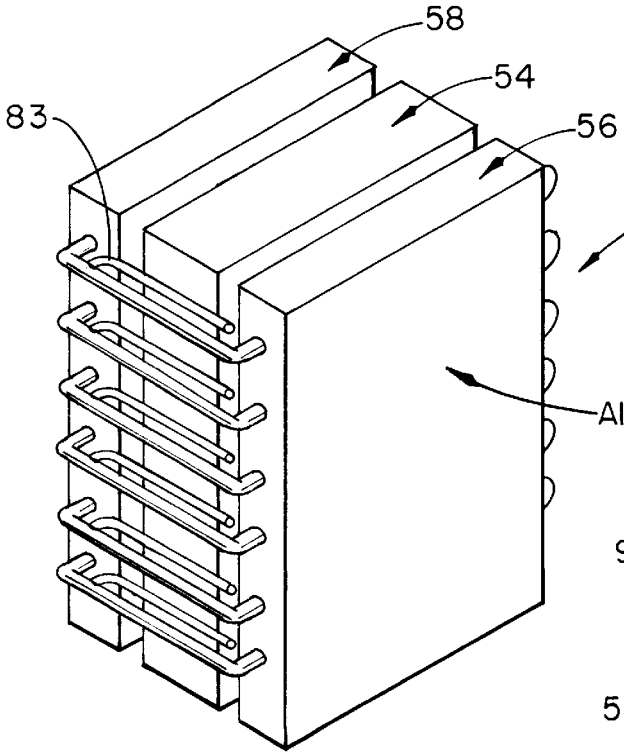
FIG. 11 is a schematic illustration of the air conditioning unit showing the air flow through the pre-cooler or evaporator coil, the main cooling coil, and the re-heater or the condenser coil.

Returning to FIG. 10 and referring now also to FIG. 11, as warm air flows across the inlet side of the hair pin tube 82B, the refrigerant absorbs heat and evaporates, that is, the refrigerant is vaporized. The refrigerant vapor travels up the hair pin end of the tube 82B and across the upper section of the tube, through the upper crossover portion 82C to the upper section of the hairpin section 82A. Air leaving the main cooling coil 54 chills the refrigerant vapor in the hairpin tube 82A causing it to condense into a liquid. The liquid refrigerant flows down the hairpin end of the tube 82A across and down the lower section of the hairpin section 82A and then returns to the bottom portion of the hairpin section 8D via the lower crossover tube 8D. This cycle continues as long as the air passing through the air conditioning coil 20 is cool enough to drive the vaporization and condensation cycle of the refrigerant.

Figure 12:
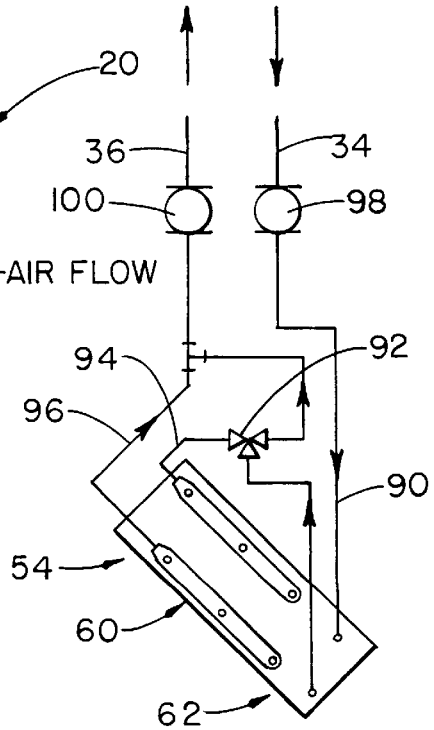
FIG. 12 is a schematic illustration of the flow system for the chilled water circulated through the two portions of the face-split main cooling coil.

Turning now to FIG. 12, the circulation system for the refrigerant in the main cooling coil 54 will be described. As explained previously, the main cooling coil 54 (See also FIGS. 4–6) is divided into a first or upper portion 60 which conditions the return or room air, and a second or lower portion 62 which conditions fresh, outside air. Chilled water is brought in through a supply line or riser 34 (FIG. 1) and directed through the conduit 90 to the second or lower portion 62 of the face-split cooling unit 54 which receives the outside air.

Upon leaving the lower portion 62, the water is directed either to the upper, room air portion 60 of the cooling coil 54 or returned directly to the return line 36, depending on whether the thermostatic control 42 has commanded activation of the room air cooling cycle. If the room air needs to be cooled, the valve 92 is opened to the conduit 94 so that chilled water passes through the first portion 60 and exits through the conduit 96 which connects to the return line 36. Valves 98 and 100 are included for isolating the main cooling coil 54 from the supply and return lines 34 and 36 in the event service or repair is needed.

What is claimed is:

1. A fan coil unit for conditioning the air inside a structure, the unit comprising:

a housing;

an air conditioning assembly in the housing, the assembly comprising;

a main coil comprising a first portion and a second portion;

a pre-cooler portion upstream of the main coil;

a re-heater portion downstream of the main coil;

a baffle positioned to direct inside air from inside the structure through the first portion of the main coil;

a baffle positioned to direct outside air through the second portion;

a valved conduit system adapted to circulate refrigerant through the main coil so that refrigerant can be continuously circulated through the second portion and can be selectively circulated through the first portion in response to the temperature of the air inside the structure;

a blower assembly adapted to circulate air through the housing; and a conditioned air outlet downstream of the heat exchanger.

2. The fan coil unit of claim 1 wherein the main coil comprises a plurality of conduits for concurrently circulating three streams of refrigerant.

3. The fan coil unit of claim 2 wherein the main coil comprises at least two conduits, and wherein one of the conduits comprise the first portion of the main coil and one of the conduits comprise the second portion of the main coil.

4. The fan coil unit of claim 1 further comprising a thermostat adapted to monitor the room air temperature, and wherein the fan coil unit further comprises a valve control responsive to the thermostat to automatically operate the valved conduit system so that when the temperature of the room air rises to a selected level the conduit system circulates refrigerant through the first portion of the main coil, and so that when the temperature of the room air lowers to a selected level refrigerant in the valved conduit system bypasses the first portion of the main coil.

5. The fan coil unit of claim 1 wherein the valved conduit system comprises valves positioned to isolate the main coil.

6. The fan coil unit of claim 1 wherein the baffle that directs inside air through the first portion of the main coil and the baffle that directs outside air through the second portion of the main coil comprise a single baffle plate.

7. The fan coil unit of claim 1 wherein the pre-cooler portion and the re-heater portion comprise at least one heat pipe formed by two C-shaped pipes positioned one above the other so that one is parallel to the other wherein the adjacent ends of the upper and lower pipes are connected by elbows to form one continuous closed loop, wherein the air conditioning assembly is tilted so that the pre-cooler portion of the heat pipe is lower than the re-heater portion of the heat pipe, wherein the heat pipe is adapted to contain refrigerant so that when air flows across the pre-cooler portion heat from the air is transferred to the refrigerant in the pre-cooler portion vaporizing the refrigerant so that the refrigerant vapor rises to the higher re-heater portion, and so that when air flows through the re-heater portion heat from the refrigerant is transferred to the air causing the refrigerant to condense and flow down and back to the pre-cooler portion.

8. The fan coil unit of claim 7 wherein the re-heater portion and the pre-cooler portion comprise a plurality of heat pipes.

9. A fan coil unit for conditioning the air inside a structure, the unit comprising:

a housing;

an air conditioning assembly in the housing, the assembly comprising a main coil comprising a first portion and a second portion, the first and second portions of the main coil being supported in a single set of non-partitioned fins;

a baffle positioned to direct inside air from inside the structure through the first portion of the main unit;

a baffle positioned to direct outside air through the second portion;

a valved conduit system adapted to circulate refrigerant through the main coil so that refrigerant can be continuously circulated through the second portion and can be selectively circulated through the first portion in response to the temperature of the air inside the structure;

a blower assembly adapted to circulate air through the housing; and a conditioned air outlet downstream of the heat exchanger.

10. The fan coil unit of claim 9 wherein the main coil comprises a plurality of conduits for concurrently circulating three streams of refrigerant.

11. The fan coil unit of claim 10 wherein the main coil comprises at least two conduits, and wherein one of the conduits comprise the first portion of the main coil and one of the conduits comprise the second portion of the main coil.

12. The fan coil unit of claim 9 further comprising a thermostat adapted to monitor the room air temperature, and wherein the fan coil unit further comprises a valve control responsive to the thermostat to automatically operate the valved conduit system so that when the temperature of the room air rises to a selected level the conduit system circulates refrigerant through the first portion of the main coil, and so that when the temperature of the room air lowers to a selected level refrigerant in the valved conduit system bypasses the first portion of the main coil.

13. The fan coil unit of claim 9 wherein the valved conduit system comprises valves positioned to isolate the main coil.

14. The fan coil unit of claim 9 wherein the baffle that directs inside air through the first portion of the main coil and the baffle that directs outside air through the second portion of the main coil comprises a single baffle plate.

* * * * *